US006367569B1

(12) United States Patent
Walk

(10) Patent No.: US 6,367,569 B1
(45) Date of Patent: Apr. 9, 2002

(54) REPLACEABLE MULTIPLE TCI KERF RING

(75) Inventor: Howard J. Walk, Arlington, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 09/591,609

(22) Filed: Jun. 9, 2000

(51) Int. Cl.[7] ..... E21B 10/00
(52) U.S. Cl. ..... 175/373; 175/376
(58) Field of Search ..... 175/373, 374, 175/376, 426, 427, 431

(56) References Cited

U.S. PATENT DOCUMENTS

| | | | | | |
|---|---|---|---|---|---|
| 2,306,683 | A | | 12/1942 | Zublin | 255/71 |
| 3,326,307 | A | | 6/1967 | Rudy | 175/374 |
| 3,679,009 | A | | 7/1972 | Goodfellow | 175/374 |
| 3,982,595 | A | * | 9/1976 | Ott | 175/373 |
| 4,040,493 | A | | 8/1977 | Saxman | 175/374 |
| 4,274,496 | A | * | 6/1981 | Liljekvisit et al. | 175/57 |
| 4,298,080 | A | * | 11/1981 | Hignett | 175/373 |
| 4,316,515 | A | | 2/1982 | Pessier | 175/372 |
| 4,441,566 | A | | 4/1984 | Pessier et al. | 175/374 |
| RE34,167 | E | * | 1/1993 | Mattsson et al. | 175/57 |
| 5,234,064 | A | | 8/1993 | Lenaburg | 175/373 |
| 5,253,723 | A | | 10/1993 | Narvestad | 175/373 |
| 5,429,201 | A | * | 7/1995 | Saxman | 175/376 |
| 5,487,435 | A | | 1/1996 | Crawley et al. | 175/363 |
| 5,598,895 | A | | 2/1997 | Anderson et al. | 175/373 |
| 5,785,135 | A | | 7/1998 | Crawley | 175/373 |

OTHER PUBLICATIONS

Brochure for "Raise Boring", by Baker Hughes Mining Tools, Inc. (undated).
Brochure for "The Shark" by Baker Hughes Mining Tools, Inc. (undated).

* cited by examiner

*Primary Examiner*—David Bagnell
(74) *Attorney, Agent, or Firm*—Bracewell & Patterson, L.L.P.

(57) ABSTRACT

An earth-boring bit for removing rock and earthen formation while being rotated includes a generally circular bit body. A plurality of saddle members are mounted to the bit body, each saddle member supporting and receiving a journal member. A cutter shell is rotatably mounted on bearings disposed on each journal member. A kerf ring is releasably secured to each cutter shell. Each kerf ring includes at least two kerfs circumferentially disposed around the rings, each kerf having a longitudinal axis and a pair of opposing sides that converge to define a crest for receiving inserts for disintegration of formation material. The kerfs are oriented on the kerf ring such that the longitudinal axes of the inserts diverge as the kerfs extend radially outward from the kerf ring. The inserts embedded in each kerf are generally flush with the sides of the kerf and protrude from the crest.

18 Claims, 3 Drawing Sheets

REPLACEABLE MULTIPLE TCI KERF RING

BACKGROUND OF THE INVENTION

1. Field of the Invention

This invention relates in general to earth-boring bits and more particularly to the design of cutters for earth-boring bits for boring relatively large-diameter holes in mining and civil construction applications.

2. Description of Related Art

Earth-penetrating tools are divided generally into two broad categories, those designed to drill deep, relatively small-diameter boreholes and those designed to drill shallow, large-diameter boreholes. Earth-boring bits with rolling cutters mounted on cantilevered bearing shafts often are called "rock bits" and are employed in drilling relatively small-diameter boreholes for the recovery of petroleum or hydrocarbons, mining minerals, or to tap geothermal energy sources.

Another type of earth-boring bit or head employs a plurality of rolling cutters, usually in excess of three, arranged to drill relatively large-diameter boreholes for mining, tunneling, or other civil construction applications. In mining or boring operations, the bit or head is secured to a drilling machine and is rotated and pushed or pulled through formation material to bore a shaft or tunnel. The cutters of these bits generally are divided into two broad categories: those that rely on protruding hard metal, usually tungsten carbide buttons or inserts, to fracture formation material, and those that rely on raised discs to fracture the formation. The cutter assemblies employing tungsten carbide buttons or inserts generate high contact or point loads at generally very small areas in the formation, resulting in relatively small cuttings and fine, abrasive particles of rock. Conversely, the disc cutter assemblies employing rings scribe circles around the formation material to be disintegrated, resulting in spalling of large cuttings or pieces of formation material. The relatively large cuttings resulting from the action of disc cutter assemblies are regarded as preferable to the smaller cuttings generated by the button or insert cutter assemblies because they require less energy-per-volume of rock removed to fracture and are easier to remove from the borehole.

There are generally two types of disc cutter assemblies. In one type, the rings or discs are formed integrally with the cutter shell material and, when worn, necessitate replacement of the entire cutter shell or sleeve. In another type, the rings are annular kerf rings replaceably secured to the cutter shell or sleeve and can be removed and replaced easily when worn. The kerf rings of the latter type of cutter assembly generally are formed of unreinforced steel or are provided with protruding hard metal inserts to take advantage of both of the fracture modes discussed above. Those formed of unreinforced steel wear too quickly in abrasive rock formations, necessitating frequent replacement. Those kerf rings with excessively protruding inserts tend to operate in a fracture mode more similar to the cutters employing solely hard metal inserts or buttons as the cutting structure, rather than in the more advantageous disc cutter mode.

The advantages of both a disc cutter and reinforced steel have been obtained by constructing replaceable kerf rings having a single kerf with tungsten carbide inserts embedded in the kerf. These kerf rings allow removal of large portions of formation and provide superior wear resistance to unreinforced steel kerfs.

When mounted on a cutter, a singular kerf ring gives a spacing across the rock formation at 3 inches or more.

Singular kerf rings with tungsten carbide insets have been used with some success, but as the spacing in between kerfs opens up to 2.5 inches or more in hard competent rock, the tungsten carbide inserts cannot handle the spacing or tight turning radius of the large diameter rings.

A need exists, therefore, for a cutter assembly for an earth-boring bit or head that employs the advantageous fracture mode of disc cutters with metal inserts, but that reduces the spacing between kerfs on a cutter.

BRIEF SUMMARY OF THE INVENTION

It is a general object of the present invention to provide an improved disc-type earth-boring bit or head for mining or civil construction applications. This and other objects of the present invention are achieved by providing a generally circular bit body. A plurality of saddle members are secured to the bit body to receive and support each end of a plurality of corresponding journal members. A cutter shell or sleeve is mounted for rotation on bearings on each journal member.

A kerf ring having at least two kerfs is releasably attached to the cutter shell. Each kerf includes a longitudinal axis and a pair of opposing sides that converge to define a crest for disintegration of formation material. The kerfs are oriented such that the longitudinal axis of each kerf is inclined relative to a radial axis that bisects the kerf ring. The two kerfs diverge as they extend radially outward from the kerf ring. A plurality of hard metal inserts are embedded and secured in rows to each kerf, the inserts being generally flush with the sides and extending to the crests of the kerfs.

According to a preferred embodiment of the present invention, the hard metal inserts in one of the kerfs are axially aligned with spaces between inserts in the other kerf. This positioning of the hard metal inserts allows for the placement of the maximum count of hard metal inserts in the two kerfs without affecting the integrity of the kerf ring.

Other objects, features, and advantages of the present invention will become apparent with reference to the drawings and detailed description which follow.

DETAILED DESCRIPTION OF THE PREFERRED EMBODIMENT

Figure 1:
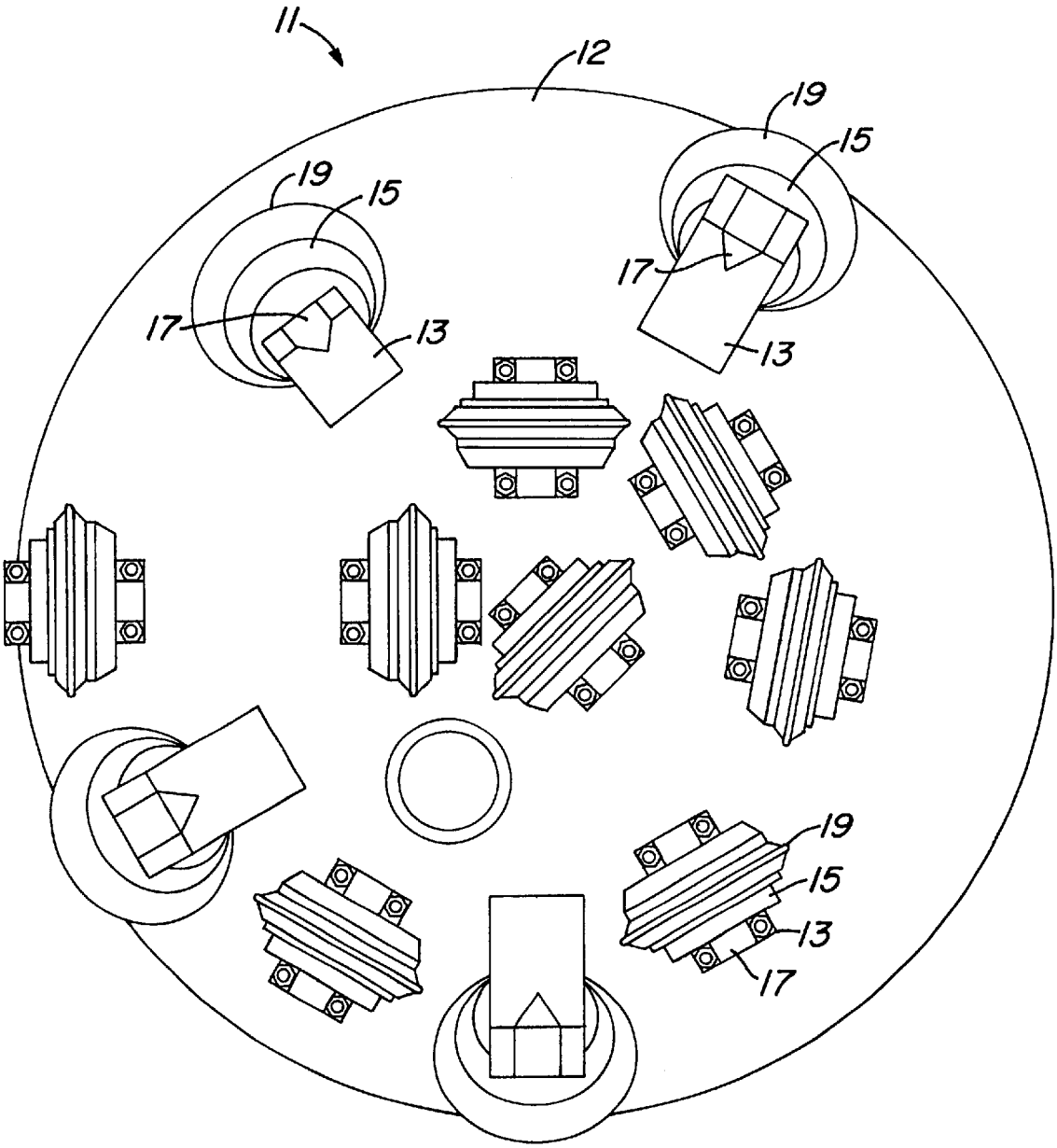
FIG. 1 illustrates a plan view of an earth-boring bit or head according to the present invention.

Referring to FIG. 1, a plan view of an earth-boring bit or head 11 according to the present invention is illustrated. Earth-boring bit 11 is typically used for shaft or tunnel boring. The bit 11 comprises a generally circular bit body 12, which is adapted to be connected to a drilling or tunneling machine (not shown) to be rotated and pushed or pulled through a rock or earthen formation to bore a shaft or tunnel.

A plurality of saddle members 13 are secured to bit body 12 at various selected locations. A cutter shell or sleeve 15 is carried for rotation by a journal member 17, each end of which is secured to and supported by saddle member 13. A preferred method of securing journal members 17 to saddle members 13 is disclosed in commonly assigned U.S. Pat. No. 5,487,453, Jan. 30, 1996, to Crawley et al.

The cutter assemblies carried by bit body 12 are known as disc-type cutters because a raised, annular kerf ring 19 is releasably secured to each cutter sleeve or shell 15. As bit body 12 is rotated and pushed or pulled through the formation, the cutter assemblies and kerf rings 19 engage the formation, scoring it in generally circular patterns and causing the fracture of large cuttings or fragments of rock from the formation. The cuttings removed by disc-type cutters (as opposed to cutters employing discrete hard-metal inserts or buttons as the primary cutting structure), such as those illustrated in FIG. 1, are removed with less energy per volume of rock fractured and produce larger cuttings, which are easier to remove from the shaft or tunnel as boring progresses.

Figure 2:
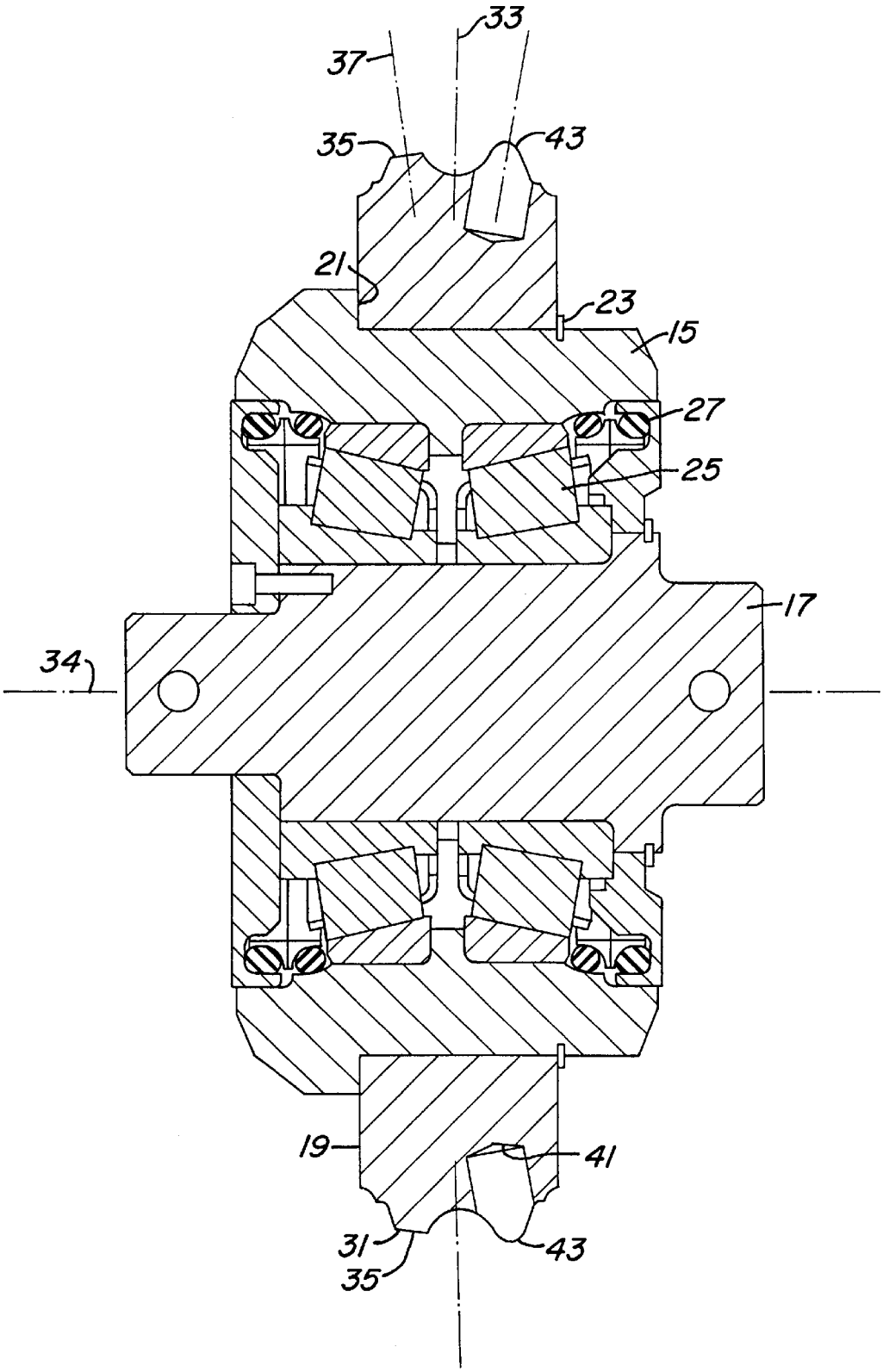
FIG. 2 illustrates a longitudinal section view of a cutter assembly that is used with the earth-boring bit of FIG. 1, the cutter assembly carrying a kerf ring according to the present invention.

FIG. 2 is a longitudinal section view of a cutter assembly of the type generally contemplated by the present invention. In both FIGS. 1 and 2, similar structure is numbered similarly. As stated above, generally cylindrical cutter shell or sleeve 15 is mounted for rotation on journal member 17. Kerf ring 19 is releasably secured to cutter shell or sleeve 15 by abutment with a radial shoulder 21 on shell 15 and is releasably retained there by a snap ring 23. Kerf ring 19 has a slightly smaller inner diameter than sleeve 15 and is pressed on to sleeve 15. Cutter shell 15 rotates on tapered roller bearings 25, which are lubricated. Lubrication is retained in the bearing area by rigid face seals 27 comprising a pair of rigid seal rings energized and urged together by a pair of o-rings. Rigid face seal 27 is provided at each end of the cutter assembly.

Figure 4:
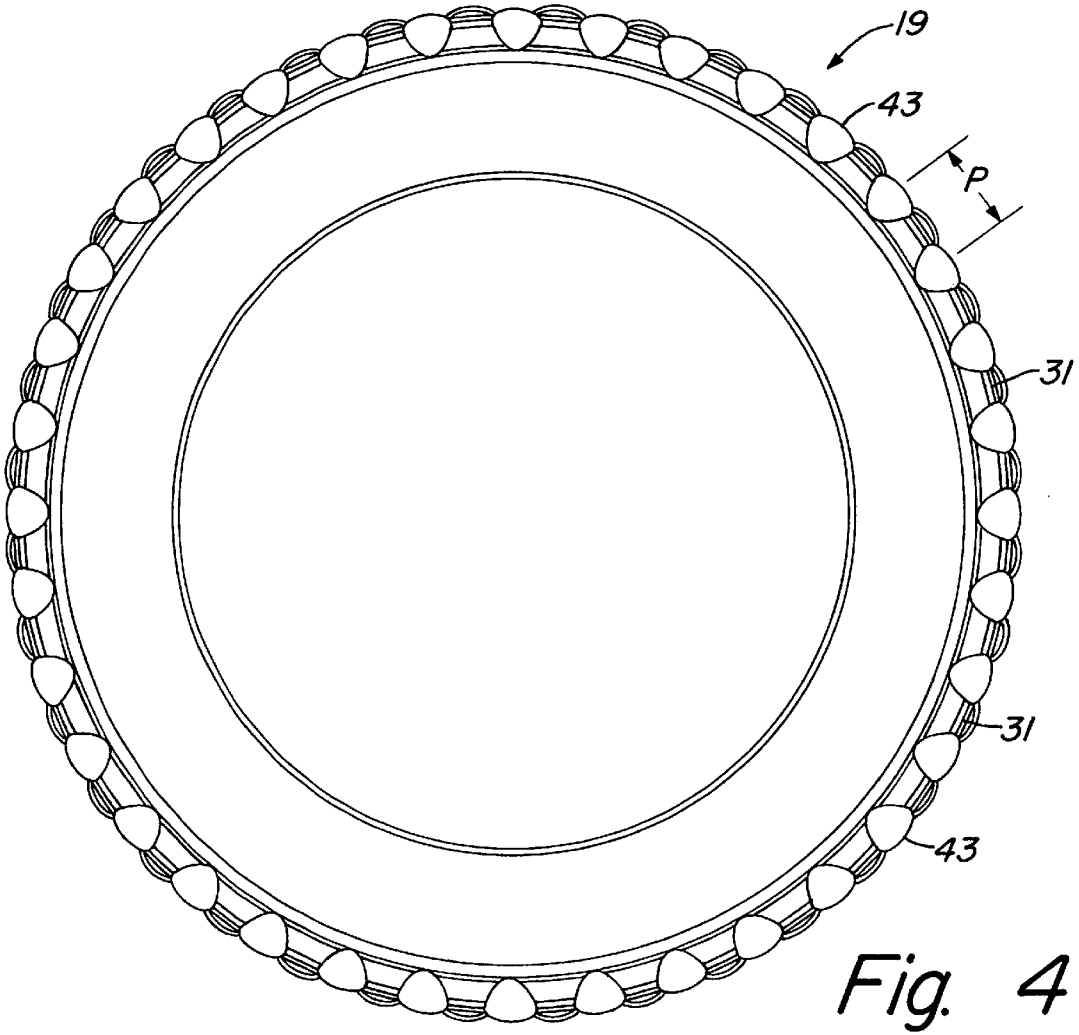
FIG. 4 illustrates a front view of the kerf ring of FIG. 2.
Figure 3:
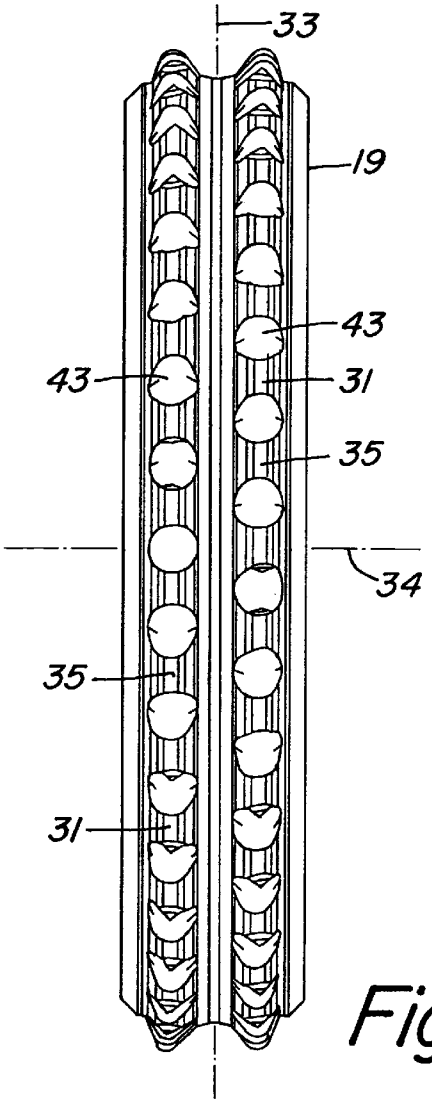
FIG. 3 illustrates a side view of the kerf ring of FIG. 2.

Referring to FIGS. 2, 3, and 4 in the drawings, kerf ring 19 includes two kerfs 31 disposed circumferentially around the kerf ring 19. A radial plane 33 (perpendicular to the view depicted in FIG. 2) bisects kerf ring 19 and is perpendicular to an axis of rotation 34. Kerfs 31 are essentially annular crests, each crest being formed by the convergence of two sides toward an outer surface 35, which is generally cylindrical, appearing flat in cross-section. The kerfs 31 are symmetrically located about radial plane 33. Each kerf 31 includes a plurality of bores 41, each having a longitudinal axis 37. The kerfs 31 are oriented such that the longitudinal axis 37 of each bore 41 is inclined in relation to radial plane 33. Also, each longitudinal axis 37 is normal to outer surface 35. Kerfs 31 diverge from radial plane 33 as they extend radially outward from the kerf ring 19. In the preferred embodiment, an angle of inclination between each longitudinal axis 37 and the radial plane 33 is between zero and thirty degrees. This angle could be outside of the preferred values, depending on the specific application.

Bores 41 extend around the entire circumference of the kerf ring 19. The bores 41 receive a plurality of hard metal inserts 43, which are preferably made of cemented tungsten carbide. The metal inserts 43 are secured in bores 41 by an interference fit. In kerf rings employing a single kerf, the circumferential spacing, or pitch P (see FIG. 4), between the metal inserts 43 can be varied to avoid "tracking" conditions. Tracking occurs when an insert 43 falls in the same indentation previously made by the same or another insert 43. The regularity of the tracking condition leads to less efficient fracture of formation material. Tracking can be avoided within a row of inserts 43 by adjusting the pitch between inserts 43 in a given row of the inserts 43. Alternately, the pitch may be uniform within each kerf ring 19.

In a preferred embodiment of the present invention, the inserts 43 in each kerf 31 are equally spaced by a distance approximately the width of one insert 43. To insure the structural integrity of the ring 19, the inserts 43 in one of the kerfs 31 are circumferentially shifted relative to the inserts 43 in the second kerf 31. The result is that the inserts 43 in the first kerf 31 axially align with the spaces between inserts 43 in the second kerf 31. This arrangement is clearly shown in FIG. 3.

A tracking avoidance scheme according to the present invention is disclosed in commonly assigned U.S. Pat. No. 4,441,566, Apr. 10, 1984 to Pessier, which is incorporated herein by reference. In this embodiment, a "random" or dispersed pattern of inserts 43 is obtained by arbitrarily placing or locating a first insert 43 in the ring, locating a second insert 43 in the ring randomly with respect to the first, locating a third insert 43 arbitrarily with respect to the second, and so on to complete a row of inserts 43 that is irregular, dispersed, or random in configuration.

Although the present invention is illustrated with two kerfs 31 disposed on kerf ring 19, it is also possible to include more than two kerfs on a single kerf ring.

One advantage of the present invention is that the tungsten carbide inserts embedded in a steel kerf provide the most durable cutting structure for raise, tunnel, and shaft boring in medium through hard rock.

Another advantage of the present invention results from the arrangement of two or more kerfs on a single kerf ring. The multiple kerf ring reduces the spacing between kerfs, which increases the amount of formation that can be successfully excavated without damaging or breaking the metal inserts.

It should be apparent from the foregoing that an invention having significant advantages has been provided. While the invention is shown in only one of its forms, it is not just limited but is susceptible to various changes and modifications without departing from the spirit thereof.

I claim:

1. An earth-boring bit comprising:

a bit body;

at least one journal member having a pair of ends;

at least one saddle member secured to the bit body to receive and support each end of the journal member;

a cutter shell mounted for rotation on the journal member;

at least one kerf ring having an axis of rotation and releasably secured to the cutter shell, the kerf ring including two kerfs located circumferentially around the kerf ring, each kerf having a pair of opposing sides that converge to define a crest for disintegration of formation material; and a plurality of hard metal inserts imbedded and secured in rows in each kerf.

2. The earth-boring bit according to claim 1 wherein the inserts in one of the kerfs are circumferentially shifted relative to the inserts in the other kerf such that the inserts in the one kerf are aligned with spaces between the inserts in the other kerf.

3. The earth-boring bit according to claim 1 wherein:

the inserts in each of the kerfs are spaced equally apart from one another; and the inserts in one of the kerfs are circumferentially shifted relative to the inserts in the other kerf such that the inserts in the one kerf are aligned with spaces between the inserts in the other kerf.

4. The earth-boring bit according to claim 1 wherein the row of inserts in one of the kerfs is spaced on one side of a radial plane of the kerf ring, and the row of inserts in the other kerf is spaced on the other side of the radial plane.

5. The earth-boring bit according to claim 1 wherein the two kerfs are inclined at an angle of inclination relative to a radial plane passing through the kerf ring, such that a longitudinal axis of each insert in each kerf diverges from the radial plane.

6. The earth-boring bit according to claim 5 wherein the angle of inclination of each kerf to the radial plane is between zero and thirty degrees.

7. The earth-boring bit according to claim 1 wherein each of the inserts protrudes from one of the crests.

8. The earth-boring bit according to claim 1 wherein an annular valley is located between the two kerfs.

9. An earth-boring bit comprising:

a bit body;

at least one journal member having a pair of ends;

at least one saddle member secured to the bit body to receive and support each end of the journal member;

a cutter shell mounted for rotation on the journal member;

at least one kerf ring having an axis of rotation releasably secured to the cutter shell, the kerf ring including two kerfs located circumferentially around the kerf ring, each kerf having a pair of opposing sides that converge to define a generally convex crest for disintegration of formation material;

a plurality of hard metal inserts imbedded and secured in rows at the crest of each kerf, the inserts in one of the kerfs being circumferentially shifted relative to the inserts in the other kerf such that the inserts in the one kerf are aligned with spaces between the inserts in the other kerf; and wherein each kerf is inclined at an angle of inclination relative to a radial plane passing through the kerf ring such that a longitudinal axis of each insert in each kerf diverges from the radial plane.

10. The earth-boring bit according to claim 9 wherein the angle of inclination of each kerf to the radial plane is between zero and thirty degrees.

11. The earth-boring bit according to claim 9 wherein the inserts in each kerf are equally spaced approximately the width of one insert from the other inserts within the same row.

12. The earth-boring bit according to claim 9 wherein the metal inserts radially protrude outward from the convex cutting surface.

13. A kerf ring for mounting to a cutter shell of an earth boring bit, comprising:

a cylindrical inner diameter for sliding onto an annular exterior surface of the cutter shell;

a pair of kerfs protruding from the kerf ring and extending circumferentially around the kerf ring, each kerf having a pair of opposing sides that converge to define a crest for disintegration of formation material;

the kerfs each being inclined at an angle of inclination relative to a radial plane passing through the kerf ring, such that a longitudinal axis of each insert in each kerf diverges from the radial plane; and a plurality of hard metal inserts imbedded and secured in rows in each kerf.

14. The kerf ring according to claim 13 wherein the inserts in one of the kerfs are circumferentially shifted relative to the inserts in the other kerf such that the inserts in the one kerf are aligned with spaces between the inserts in the other kerf.

15. The kerf ring according to claim 13 wherein:

the inserts in each of the kerfs are spaced equally apart from one another; and the inserts in one of the kerfs are circumferentially shifted relative to the inserts in the other kerf such that the inserts in the one kerf are aligned with spaces between the inserts in the other kerf.

16. The kerf ring according to claim 13 wherein the row of inserts in one of the kerfs is spaced on one side of a radial plane of the kerf ring, and the row of inserts in the other kerf is spaced on the other side of the radial plane.

17. The kerf ring according to claim 13 wherein the angle of inclination of each kerf to the radial plane is between zero and thirty degrees.

18. The kerf ring according to claim 13 wherein each of the inserts protrudes from one of the crests.

* * * * *